US006742566B2

(12) United States Patent
Nishikawa et al.

(10) Patent No.: US 6,742,566 B2
(45) Date of Patent: Jun. 1, 2004

(54) DIE CASTING MACHINE AND DIE CASTING METHOD

(75) Inventors: Koji Nishikawa, Okazaki (JP); Toshihiko Hamada, Nishio (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/252,294

(22) Filed: Sep. 23, 2002

(65) Prior Publication Data

US 2003/0062142 A1 Apr. 3, 2003

(30) Foreign Application Priority Data

Sep. 28, 2001 (JP) ..... 2001-302826

(51) Int. Cl.[7] ..... B22C 3/00; B22D 17/00

(52) U.S. Cl. ..... 164/72; 164/113; 164/267; 164/312

(58) Field of Search ..... 164/72, 74, 267, 164/113, 312; 264/338; 425/98–106

(56) References Cited

U.S. PATENT DOCUMENTS 6,461,669 B1 * 10/2002 Hanano et al. ..... 427/135

2002/0011691 A1 * 1/2002 Suzuki et al. ..... 264/238

FOREIGN PATENT DOCUMENTS

| | | |
|---|---|---|
| EP | 1057559 | 12/2000 |
| JP | 2000-343194 | 12/2000 |
| JP | 2001-47209 | 2/2001 |

* cited by examiner

*Primary Examiner*—Kuang Y. Lin
(74) *Attorney, Agent, or Firm*—Harness, Dickey & Pierce, PLC

(57) ABSTRACT

The die casting machine 1 comprises: a metallic mold 2 including a product cavity section 21 for forming a die casting product 8, a plunger sleeve section 22 and a runner 23; a decompressing device 4 for decompressing the inside of the metallic mold 2; a powder supply source 5 for supplying a powder mold releasing agent 6 into the metallic mold 2; and a powder discharging pin 3 arranged in the runner 23 in a retractable condition. The powder discharging pin 3 includes: a first opening section 311 to open the powder introducing passage 31, which is connected with the powder supply source 5, to the product cavity section 21 and a second opening section 312 to open the powder introducing passage 31 to the plunger sleeve section 22, when the powder discharging pin 3 advances into the runner 23.

14 Claims, 12 Drawing Sheets

DIE CASTING MACHINE AND DIE CASTING METHOD

BACKGROUND OF THE INVENTION

1. Field of the Invention

The present invention relates to a die casting machine for producing a die casting product by charging molten metal, which has been injected from a plunger sleeve section provided in a metallic mold, into a product cavity section via a runner. The present invention also relates to a die casting method.

2. Description of the Related Art

As shown in FIG. 14, a die casting product is produced by the die casting machine 9 in such a manner that molten metal, which has been injected from the plunger sleeve section 922, is charged into the product cavity section 921 via the runner 923, so that the die casting product can be produced in the product cavity section 921. When molten metal is charged into the product cavity section 921, gas pressure in the product cavity section 921 is increased. Therefore, molten metal cannot be sufficiently filled in the product cavity section 921. In order to solve the above problem, gas remaining in the product cavity section 921 is discharged outside by the decompression device 94.

In the above die casting machine 9, in order to enhance the mold releasing property of a die casting product and a molding, which are respectively formed in the molding section 920 composed of the product cavity section 921, the plunger sleeve section 922 and runner 923, and, further, in order to enhance the lubricating property of the plunger chip in the molding section 920 and, furthermore, in order to enhance the heat reserving property of molten metal, the powder mold releasing agent 6 is supplied from the plunger sleeve section 922.

In this connection, recently, the die casting device 9 has seen wide application from a small size die casting product to a large size die casting product. Further, the die casting device 9 is used not only for a simple die casting operation such as conducting a die casting operation for a single die casting product but also for a complicated die casting operation such as conducting a die casting operation for a plurality of die casting products.

However, in the conventional die casting machine 9 described above, the powder mold releasing agent 6 is supplied only from the plunger sleeve section 922. That is, the product cavity section 921 is distant from the plunger sleeve section 922. Accordingly, there is a possibility that the powder mold releasing agent 6 may not sufficiently spread into the product cavity section 921.

Further, when the powder mold releasing agent 6 is supplied from the plunger sleeve section 922, there is a possibility that the powder mold releasing agent 6 may not be uniformly supplied to between the product cavity section 921 and the plunger sleeve section 922. The aforementioned problems may become remarkable in the case where a complicated die casting product is produced.

SUMMARY OF THE INVENTION

The present invention has been accomplished to solve the above conventional problems. It is an object of the present invention to provide a die casting machine and die casting method capable of supplying a powder mold releasing agent to a product cavity section, a plunger sleeve section and a runner in a well balanced condition so as to produce a die casting product of high quality.

One aspect of the present invention is a die casting machine comprising:

- a metallic mold including a plunger sleeve section for injecting molten metal, a product cavity section for molding a die casting product when molten metal is charged into it and a runner for connecting the plunger sleeve section with the product cavity section;
- a decompressing device for decompressing the plunger sleeve section and the product cavity section;
- a powder supply source for supplying a powder mold releasing agent to the plunger sleeve section and the product cavity section; and
- a powder discharging pin arranged in the runner in a retractable state, having a powder introducing passage connected with the powder supply source, wherein the powder discharging pin includes a first opening section to open the powder introducing passage toward the product cavity section and a second opening section to open the powder introducing passage toward the plunger sleeve section, when the powder discharging pin proceeds into the runner.

The die casting machine of the present invention includes a powder discharging pin having a powder introducing passage connected with a powder supply source for supplying a powder mold releasing agent. In order to supply a sufficiently large quantity of powder mold releasing agent to the product cavity section, this powder discharging pin is arranged so that it can protrude into a runner located between the product cavity section and the plunger sleeve section.

The powder discharging pin includes: a first opening section which can open the powder introducing passage toward the product cavity section and a second opening section which can open the powder introducing passage toward the plunger sleeve section, when the powder discharging pin proceeds into the runner.

Due to the first and the second opening section, a plurality of discharging ports to the product cavity section and the plunger sleeve section are formed from one introducing passage of the powder mold releasing agent connected with the powder supply source. It is possible to directly supply the powder mold releasing agent toward the product cavity section and the plunger sleeve section from the plurality of discharging ports, that is, from the first and the second opening section.

Therefore, it is possible to uniformly spread the powder mold releasing agent to each portion including the product cavity section, the plunger sleeve section and the runner. Due to the foregoing, the powder mold releasing agent can be supplied in a well balanced state to the product cavity section, the plunger sleeve section and the runner in the metallic mold.

Due to the foregoing, for example, even in the case of a large die casting molding, the profile of which is complicated, or even in the case of a complicated die casting molding, in which a plurality of products are molded at one die casting operation, the above powder discharging pin can exhibit an excellent performance, and operation can be flexibly conducted.

When the plunger sleeve section and the product cavity section are decompressed by the decompressing device, the powder mold releasing agent can be more effectively supplied to the plunger sleeve section and the product cavity section.

The powder discharging pin is arranged in a retractable state with respect to the runner. Therefore, after the powder mold releasing agent has been supplied from the powder discharging pin, it is possible to retract this powder discharging pin. Therefore, when molten metal is charged into the product cavity section via the runner, it is possible to prevent the powder discharging pin from blocking the charge of molten metal.

Therefore, according to the die casting machine of the present invention, the powder mold releasing agent can be supplied in a well balanced condition to the product cavity section, the plunger sleeve section and the runner, and a die casting product of high quality can be produced.

Another aspect of the present invention is a die casting method in which molten metal is injected from a plunger sleeve section provided in a metallic mold and the injected molten metal is filled in a cavity product section via a runner so as to produce a die casting product, comprising the steps of:

decompressing the product cavity section and the plunger sleeve section before molten metal is injected from the plunger sleeve section, when a powder mold releasing agent is supplied to the product cavity section and the plunger sleeve section;

advancing a powder discharging pin, which is arranged in the runner in a retractable state and has a powder introducing passage connected with a powder supply source, into the runner;

opening a first opening section provided in the powder introducing passage of the powder discharging pin toward the product cavity section and also opening a second opening section provided in the powder introducing passage toward the plunger sleeve section ; and discharging the powder mold releasing agent from the first and the second opening section.

In the present invention, before molten metal is injected by the plunger sleeve section, the powder mold releasing agent is supplied to the product cavity section, the plunger sleeve section and the runner by utilizing the powder discharging pin. When the powder mold releasing agent is supplied to each portion of the metallic mold, each portion is decompressed by the decompressing device.

Then, the powder discharging pin is advanced into the runner. In this case, the first opening section provided in the powder introducing passage of the powder discharging pin is opened toward the product cavity section, and the second opening section provided in the powder introducing passage of the powder discharging pin is opened toward the plunger sleeve section.

Then, the powder mold releasing agent flowing in the powder introducing passage from the powder supply source is discharged from the first and the second opening portion. Due to the foregoing, the powder mold releasing agent can be directly supplied from the first opening section toward the product cavity section and from the second opening section toward the plunger sleeve section.

Therefore, according to the die casting method of the present invention, in the same manner as that of the die casting machine described before, the powder mold releasing agent can be supplied to the product cavity section, the plunger sleeve section and the runner in a well balanced condition. Accordingly, a die casting product of high quality can be produced.

The present invention may be more fully understood from the description of preferred embodiments of the invention, as set forth below, together with the accompanying drawings.

BRIEF DESCRIPTION OF THE DRAWINGS

In the drawings:

FIG. 2 is a view showing the die casting machine of Embodiment 1, wherein FIG. 2 is a sectional schematic illustration showing a state in which a powder mold releasing agent is supplied from a powder discharging pin into a metallic mold;

FIG. 3 is a view showing the powder discharging pin of Embodiment 1, wherein FIG. 3 is a sectional schematic illustration showing a state in which the powder discharging pin is advanced;

FIG. 4 is a view showing the powder discharging pin of Embodiment 1, wherein FIG. 4 is a sectional schematic illustration showing a state in which the powder discharging pin is retracted;

FIG. 7 is a view showing the die casting machine of Embodiment 1, wherein FIG. 7 is a sectional schematic illustration showing a state in which molten metal is injected from a plunger sleeve section;

FIG. 8 is a view showing the die casting machine of Embodiment 1, wherein FIG. 8 is a sectional schematic illustration showing a state in which pressure in the metallic mold is reduced after molten metal has been injected;

FIG. 9 is a view showing the die casting machine of Embodiment 1, wherein FIG. 9 is a sectional schematic illustration showing a state in which molten metal is charged into a runner and a product cavity section;

FIG. 10 is a view showing the die casting machine of Embodiment 1, wherein FIG. 10 is a sectional schematic illustration showing a state in which a die casting product is taken out from the metallic die;

DESCRIPTION OF THE PREFERRED EMBODIMENTS

Embodiment 1

Referring to FIGS. 1 to 10, the die casting machine and the die casting method of the present invention will be explained below.

Figure 1:
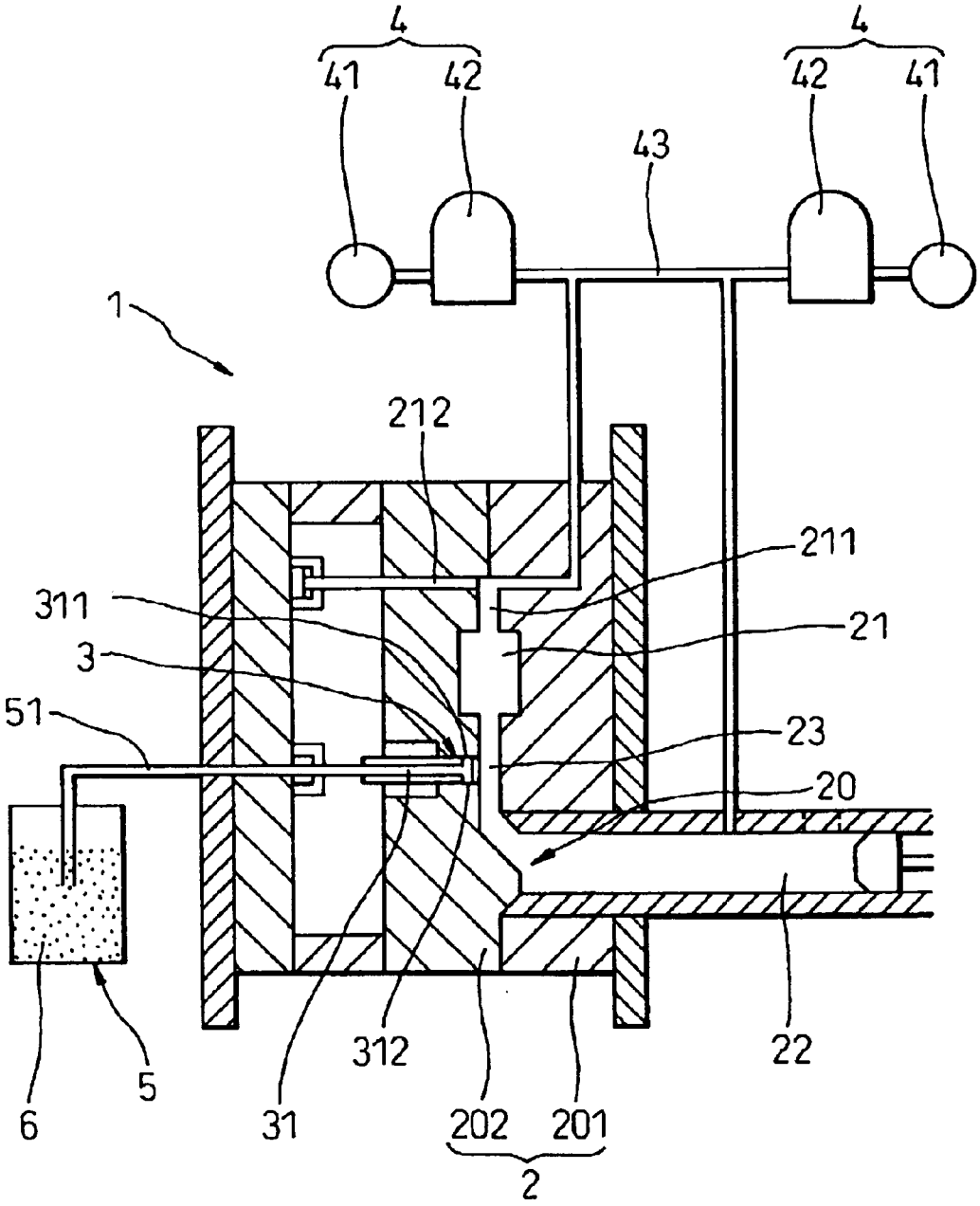
FIG. 1 is a sectional schematic illustration showing a die casting machine of Embodiment 1 of the present invention.

As shown in FIG. 1, the die casting machine 1 of this embodiment includes: a metallic mold 2 for casting a die casting product 8; a decompressing device 4; and a powder supply source 5.

The metallic mold 2 includes: a plunger sleeve section 22 for injecting molten metal; a product cavity section 21 for forming a die casting product 8 when molten metal 7 is charged into it; and a runner 23 for connecting the plunger sleeve section 22 with the product cavity section 21.

Figure 2:
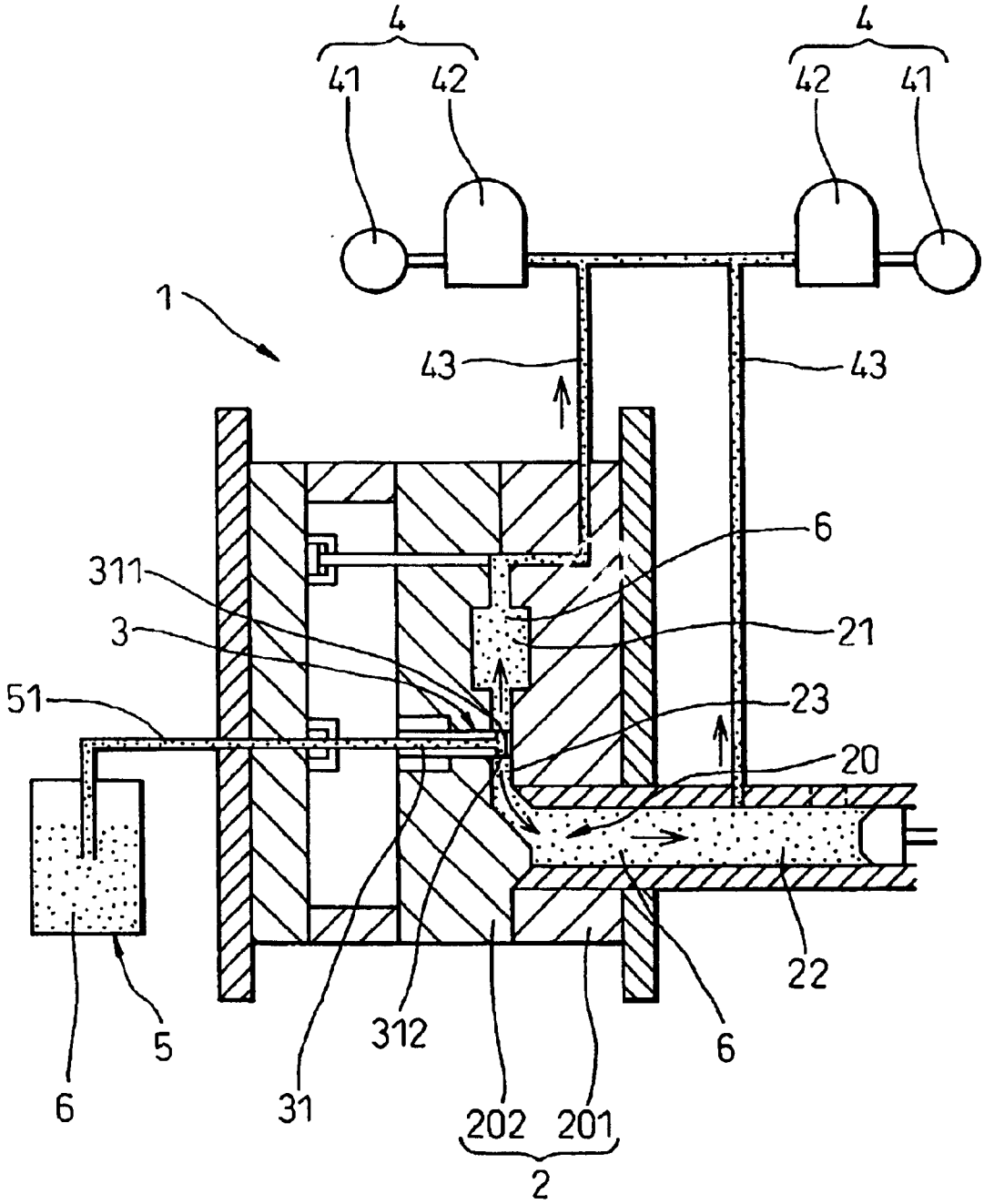

As shown in FIG. 2, the decompressing device 4 is composed so that pressure in the plunger sleeve section 22 and the product cavity section 21 can be reduced. The powder supply source 5 is composed so that the powder mold releasing agent 6 can be supplied to the plunger sleeve section 22 and the product cavity section 21.

Figure 3:
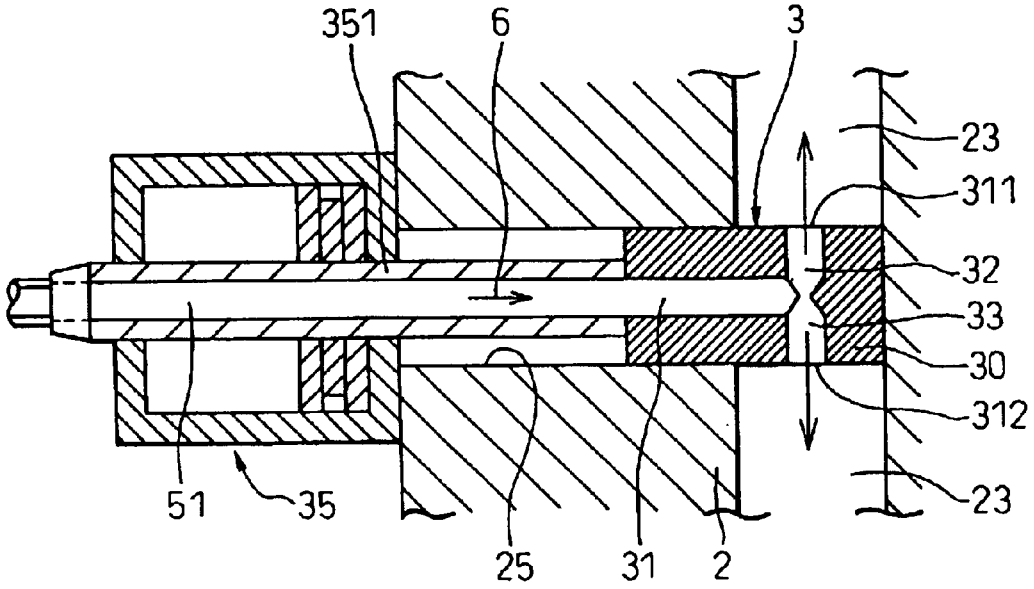

As shown in FIG. 3, the die casting machine 1 of this embodiment includes a powder discharging pin 3 which is arranged in a retractable state in which the powder discharging pin 3 can be advanced to and retracted from the runner 23, and this powder discharging pin 3 is provided with a powder introducing passage 31 connected with the powder supply source 5. This powder discharging pin 3 includes: a first opening section 311 to open the powder introducing passage 31 toward the product cavity section 21 and a second opening section 312 to open the powder introducing passage 31 toward the plunger sleeve section 22, when the powder discharging pin 3 is advanced into the runner.

This structure will be explained in detail as follows.

As shown in FIG. 1, the metallic mold 2 of the die casting machine 1 includes: a first metallic mold section 201 in which the plunger sleeve section 22 is provided; and a second metallic mold section 202 opposed to the first metallic mold section 201. When the first metallic mold section 201 and the second metallic mold section 202 are arranged being opposed to each other, the product cavity section 21 and the runner 23 are formed between the first metallic mold section 201 and the second metallic mold section 202. When the first metallic mold section 201 and the second metallic mold section 202 are opposed to each other in this way, the plunger sleeve section 22 and the runner 23 are combined with each other.

Figure 10:
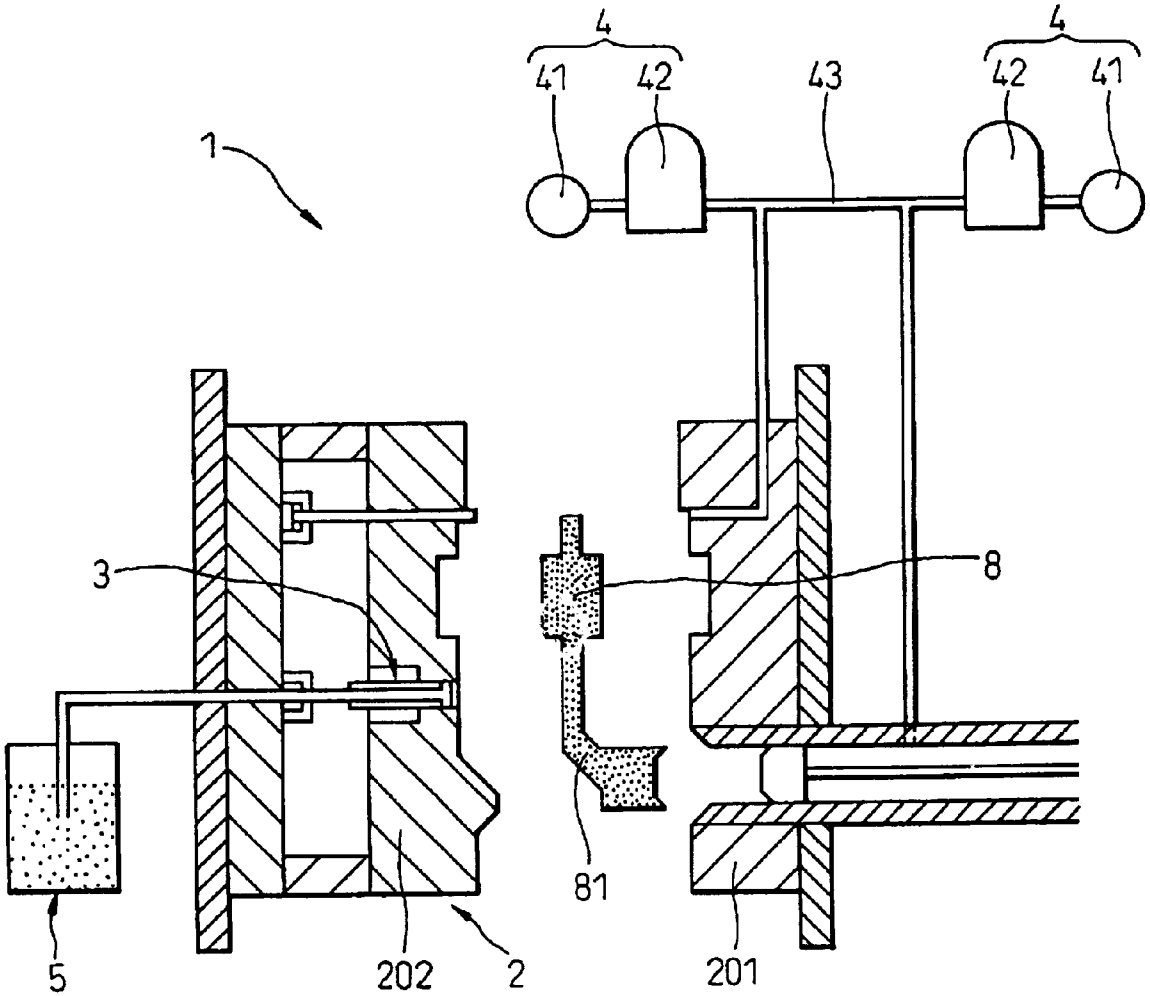

When the first metallic mold section 201 and the second metallic mold section 202 of the metallic mold 2 are relatively moved from each other, it is possible to pick up a die casting product 8, which has been formed in the product cavity section 21, and also it is possible to pick up a molding 81 which has been formed in the plunger sleeve section 22 and the runner 23 as shown in FIG. 10.

In this connection, the product cavity section 21, the plunger sleeve section 22 and the runner 23 are referred to as a metallic mold forming section 20 of the metallic mold 2 in this specification, hereinafter.

In the metallic mold 2, in a portion of the product cavity section 21 which is located on the opposite side to a portion with which the runner 23 is connected, there is provided a gas breathing passage 211 through which gas generated in the metallic mold forming section 20 is discharged outside the metallic mold 2.

In the above gas breathing passage 211, there is provided a cut-off pin 212 by which molten metal 7 exceeding a volume of the product cavity section 21 is prevented from overflowing from the gas breathing passage 211 after molten metal 7 has been charged into the product cavity section 21.

The decompressing device 4 is directly connected with the gas breathing passage 211 of the product cavity section 21 and the plunger sleeve section 22 by the piping 43. Gas in the product cavity section 21 and the plunger sleeve section 22 is directly sucked out by the decompressing device 4, so that the product cavity section 21 and the plunger sleeve section 22 can be decompressed. The decompressing device 4 includes a vacuum pump 41 and a vacuum tank 42.

The above die casting machine 1 includes two sets of decompressing devices 4. Both of the decompressing devices 4 are connected with the gas breathing passage 211 and the plunger sleeve section 22 via the piping 43. When two sets of the decompressing devices 4 are operated at a different decompression timing or alternatively when two sets of the decompressing devices 4 are operated at the same decompressing timing, it is possible to operate the decompressing devices 4 while a lack of the capacity of each decompressing device 4 is covered at each other, and the metallic mold forming section 20 can be quickly decompressed.

The powder discharging pin 3 is connected with the powder supply source 5 when the powder introducing passage 31 is connected with the piping 51.

As shown in FIG. 3, the powder discharging pin 3 is embedded in the metallic mold 2 in such a manner that the powder discharging pin 3 can be advanced to and retracted from the runner 23. In this embodiment, the powder discharging pin 3 is inserted into the pin hole 25 formed in the metallic mold 2.

The powder discharging pin 3 is fixed to the rod section 351 of the cylinder 35. When the cylinder 35 is operated between the advancing position and the returning position, the powder discharging pin 3 can be advanced to and retracted from the runner 23.

The powder introducing passage 31 of the powder discharging pin 3 branches at the inside of this powder discharging pin 3 into the first 32 and the second branch section 33. At the end of the first branch section 32, the first opening section 311 is formed and, at the end of the second branch section 33, the second opening section 312 is formed.

The first 311 and the second opening section 312 are arranged at the forward end section 30 of the powder discharging pin 3. When the powder discharging pin 3 is advanced, the forward end portion 30 comes to a position in the runner 23.

Next, the advancing and retracting motions of the powder discharging pin 3 will be explained below.

The powder discharging pin 3 is advanced when the powder mold releasing agent 6 is discharged from the powder discharging pin 3 in the runner 23 of the metallic mold 2. When the powder discharging pin 3 is advanced as described above, the forward end section 30 of the powder discharging pin 3 intercepts a state of communication between the product cavity section 21 and the plunger sleeve section 22 in the runner 23.

In this case, the state of communication between the product cavity section 21 and the plunger sleeve section 22 is defined as a state in which a sectional area of the passage in the runner 23 is not extremely changed so that a flow of the molten metal 7 cannot be affected. The state of interception between the product cavity section 21 and the plunger sleeve section 22 is defined as a state in which the sectional area of the passage is extremely reduced when the powder discharging pin 3 is located in the runner 23.

When the state of communication is intercepted, the first opening section 311 and the second opening section 312 are respectively opened toward the product cavity section 21 and the plunger sleeve section 22. In this way, the powder mold releasing agent 6 can be discharged from the first 311 and the second opening section 312 toward the product cavity section 21 and the plunger sleeve section 22.

When the state of communication is intercepted as described above, it is possible to prevent the powder mold releasing agent 6, which has been discharged from the first opening section 311, and the powder mold releasing agent 6, which has been discharged from the second opening section 312, from mixing with each other.

Figure 4:
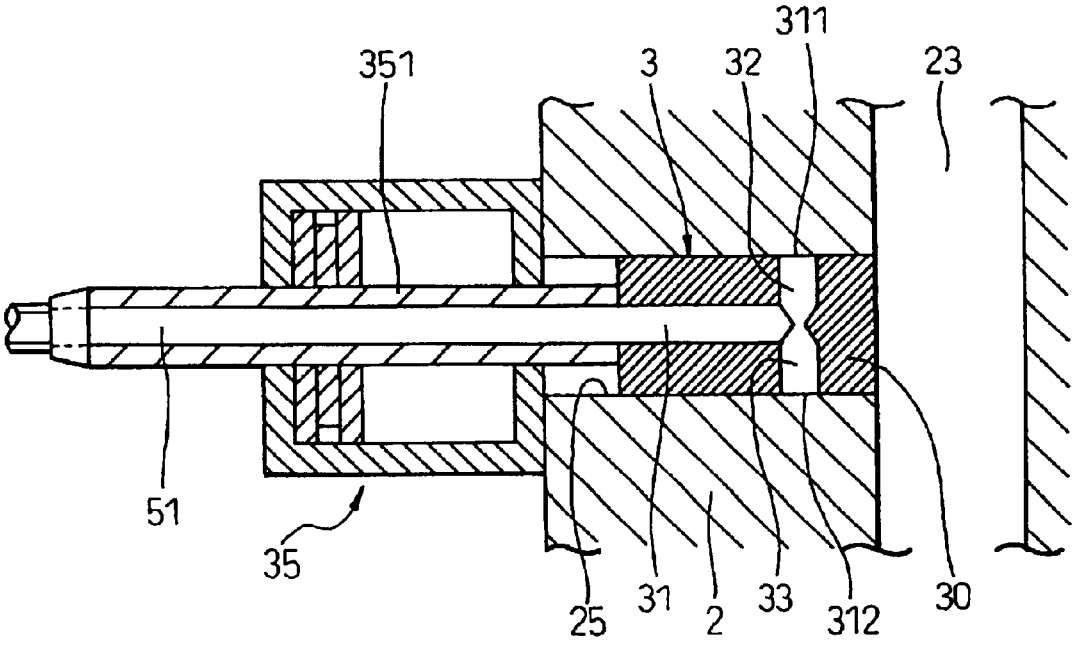

As shown in FIG. 4, after the powder mold releasing agent 6 has been discharged from the powder discharging pin 3 into the runner 23, the powder discharging pin 3 is retracted. After the powder discharging pin 3 is retracted from the runner 23, the state of communication between the product cavity section 21 and the plunger sleeve section 22 is restored.

Then, the molten metal 7 injected from the plunger sleeve 22 is charged into the product cavity section 21 via the runner 23. At this time, as the powder discharging pin 3 is not protruded into the runner 23, the powder discharging pin 3 does not prevent the charging motion of the molten metal 7 into the product cavity section 21.

Figure 5:
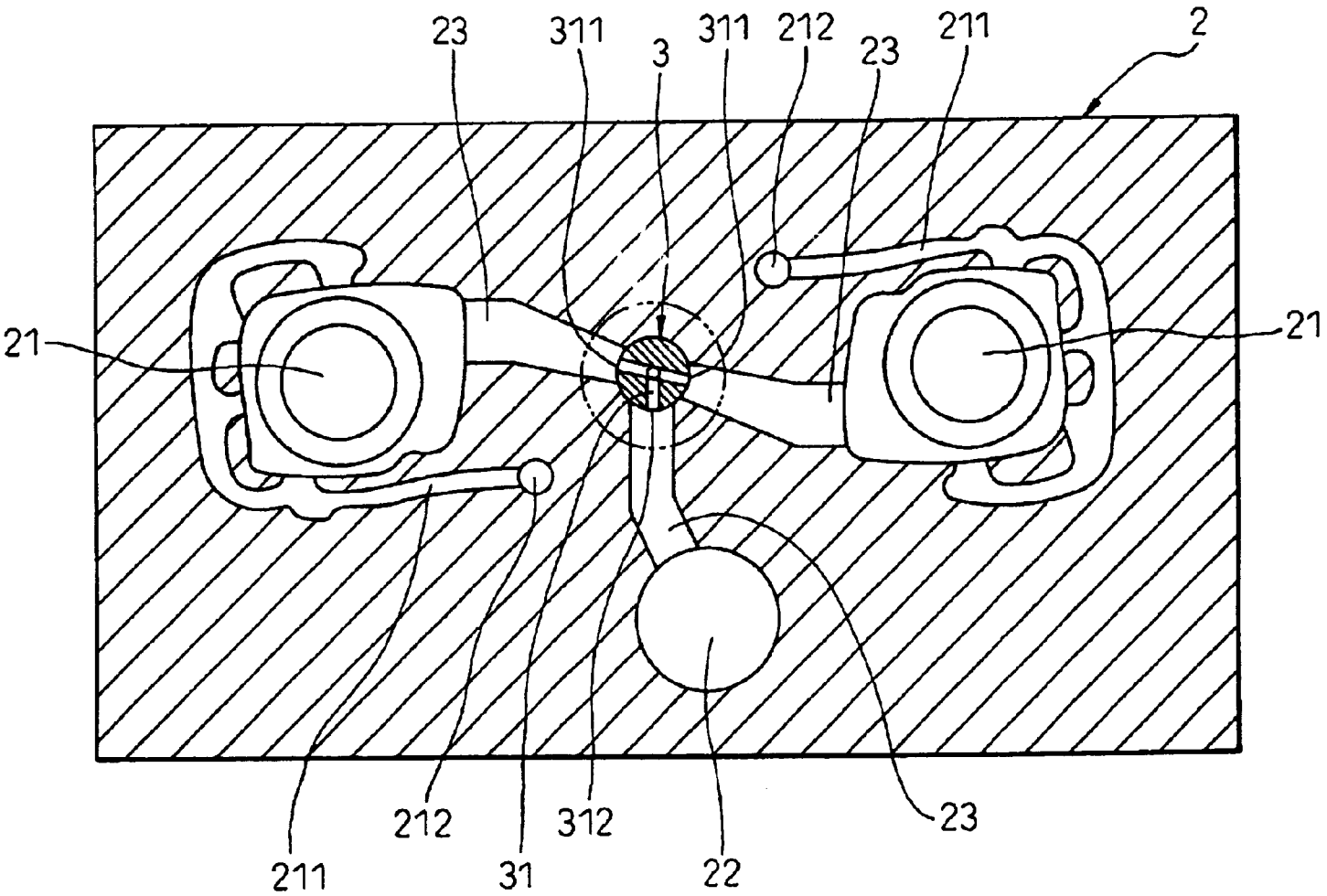
FIG. 5 is a schematic illustration showing an arrangement of the powder discharging pin in the metallic mold of Embodiment 1.

As shown in FIG. 5, the die casting machine 1 of this embodiment simultaneously casts two die casting products 8 by one die casting operation.

In the above metallic die 2, there are two product cavity sections 21. There are provided a plurality of first opening sections 311 so that the first opening sections 311 can be opened toward the two product cavity sections 21. The gas breathing passage 211 and the cutoff pin 212 are provided for each product cavity section 21.

Figure 6:
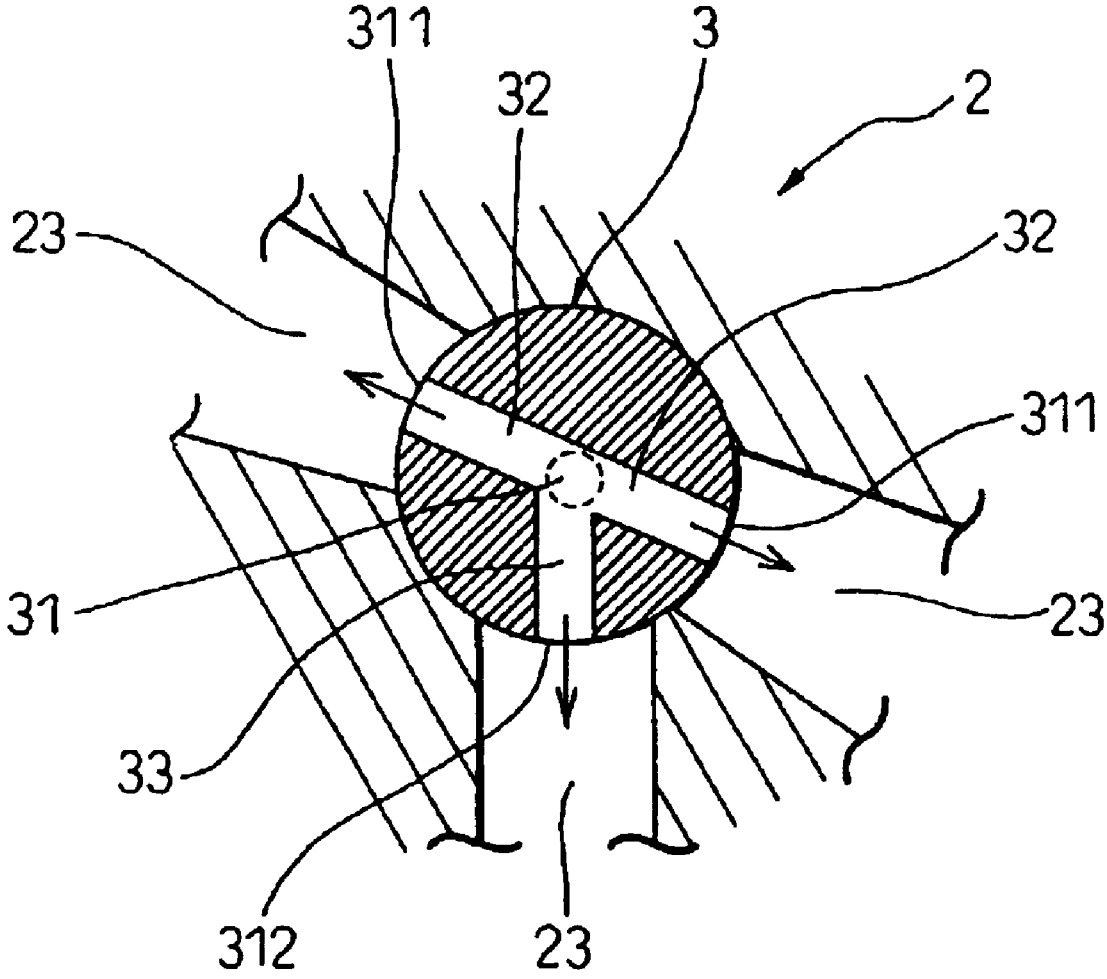
FIG. 6 is a schematic illustration showing an inner structure of the powder discharging pin in Embodiment 1.

As shown in FIG. 6, the powder introducing passage 31 branches into the two first branch sections 32 and the one second branch section 33 in the powder discharging pin 3. The first opening section 311 is formed at the forward end of each of the two first branch sections 32 and the second opening section 312 is formed at the forward end of the second branch section 33.

In this connection, in this embodiment, an area of the opening of the first opening section 311 is the same as that of the opening of the second opening section 312. When a ratio of the area of the opening of the first opening section 311 to the area of the opening of the second opening section 312 is changed, it is possible to adjust a ratio of the quantity of supply of the powder mold releasing agent 6 to the product cavity section 21 to the quantity of supply of the powder mold releasing agent 6 to the plunger sleeve section 22.

Next, explanations will be made into a die casting method by which the die casting product 8 is produced with the above die casting machine 1.

As shown in FIG. 1, when the die casting product 8 is produced in the metallic mold 2, the operation is conducted as follows. First, the first metallic mold section 201 and the second metallic mold section 202 are arranged being opposed to each other, so that the product cavity section 21 and the runner 23 are formed between the first metallic mold 201 and the second metallic mold 202, and the runner 23 is connected with the plunger sleeve 22. In this way, the metallic mold forming section 20 is formed, and the product cavity section 21 and the plunger sleeve section 22 are respectively decompressed by the decompressing device 4. In this way, pressure in the metallic mold forming section 20 is reduced.

Next, as shown in FIG. 2, when the cylinder 35 is operated so that it can be located on the advancing side, the powder discharging pin 3 is advanced into the runner 23. At this time, the forward end section 30 of the powder discharging pin 3, at which the first opening section 311 and the second opening section 312 are arranged, are located in the runner 23. The first opening section 311 provided in the powder introducing passage 31 of the powder discharging pin 3 is open toward the product cavity section 21, and the second opening section 312 provided in the powder introducing passage 31 of the powder discharging pin 3 is open toward the plunger sleeve section 22.

The powder mold releasing agent 6 is supplied into the powder introducing passage 31 of the powder discharging pin 3 from the powder supply source 5 via the piping 51. Then, the powder mold releasing agent 6 supplied to the powder introducing passage 31 flows while branching into the first branch section 32 and the second branch section 33. The powder mold releasing agent 6 is discharged into the product cavity sections 21 from the two first opening sections 311. Also, the powder mold releasing agent 6 is discharged into the plunger sleeve section 22 from the second opening section 312 as shown in FIG. 6.

In this case, the metallic mold forming section 20, which includes the product cavity section 21, the plunger sleeve section 22 and the runner 23, has already been decompressed by the decompressing device 4. Therefore, the powder mold releasing agent 6 can be quickly supplied into the entire metallic mold forming section 20.

Figure 7:
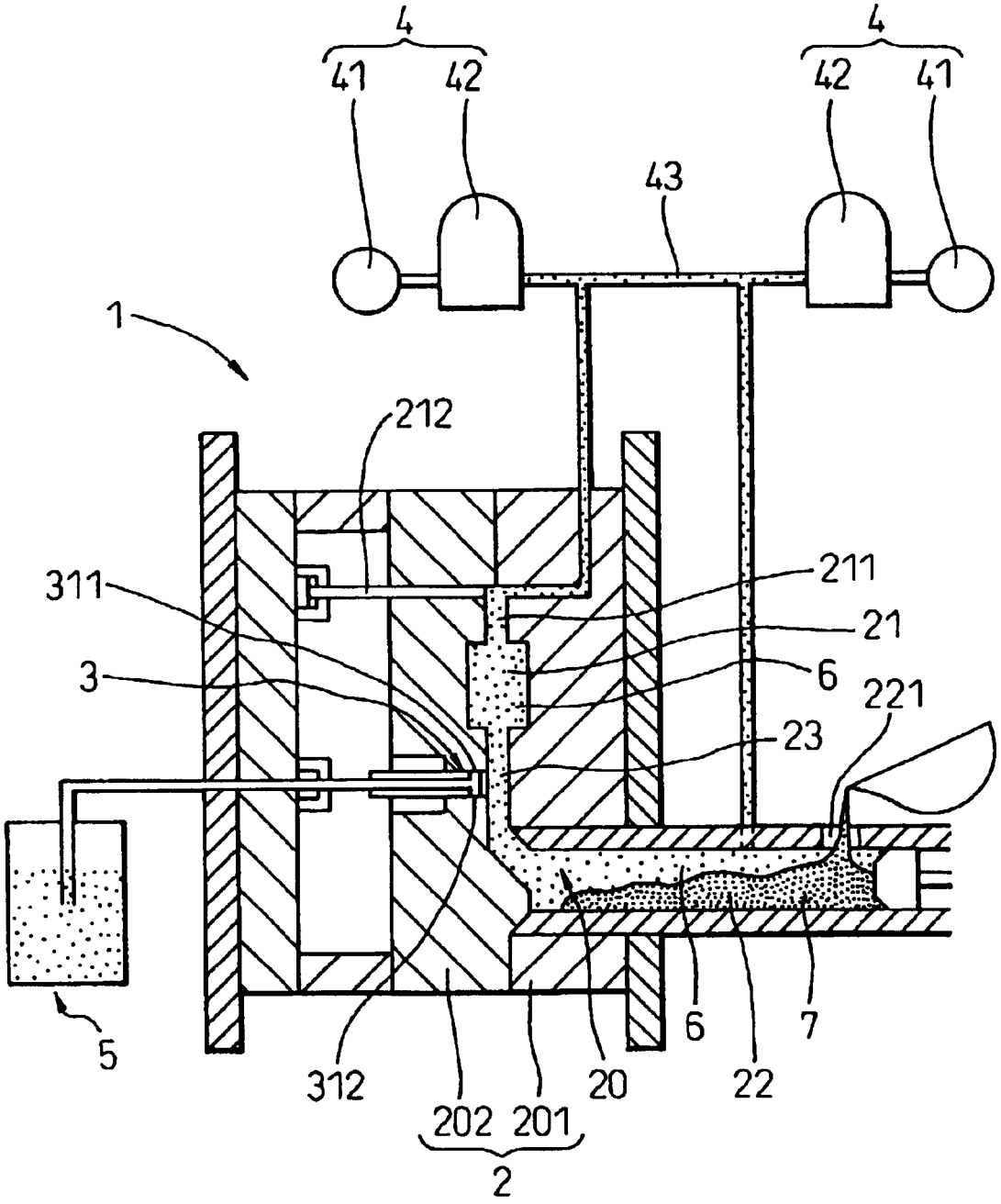

Next, as shown in FIG. 7, the molten metal 7 is poured from the molten metal pouring port 221 arranged in the plunger sleeve section 22. In the case of pouring the molten metal 7, gas is mixed from the outside into the metallic mold forming section 20 via the molten metal pouring port 221.

Figure 8:
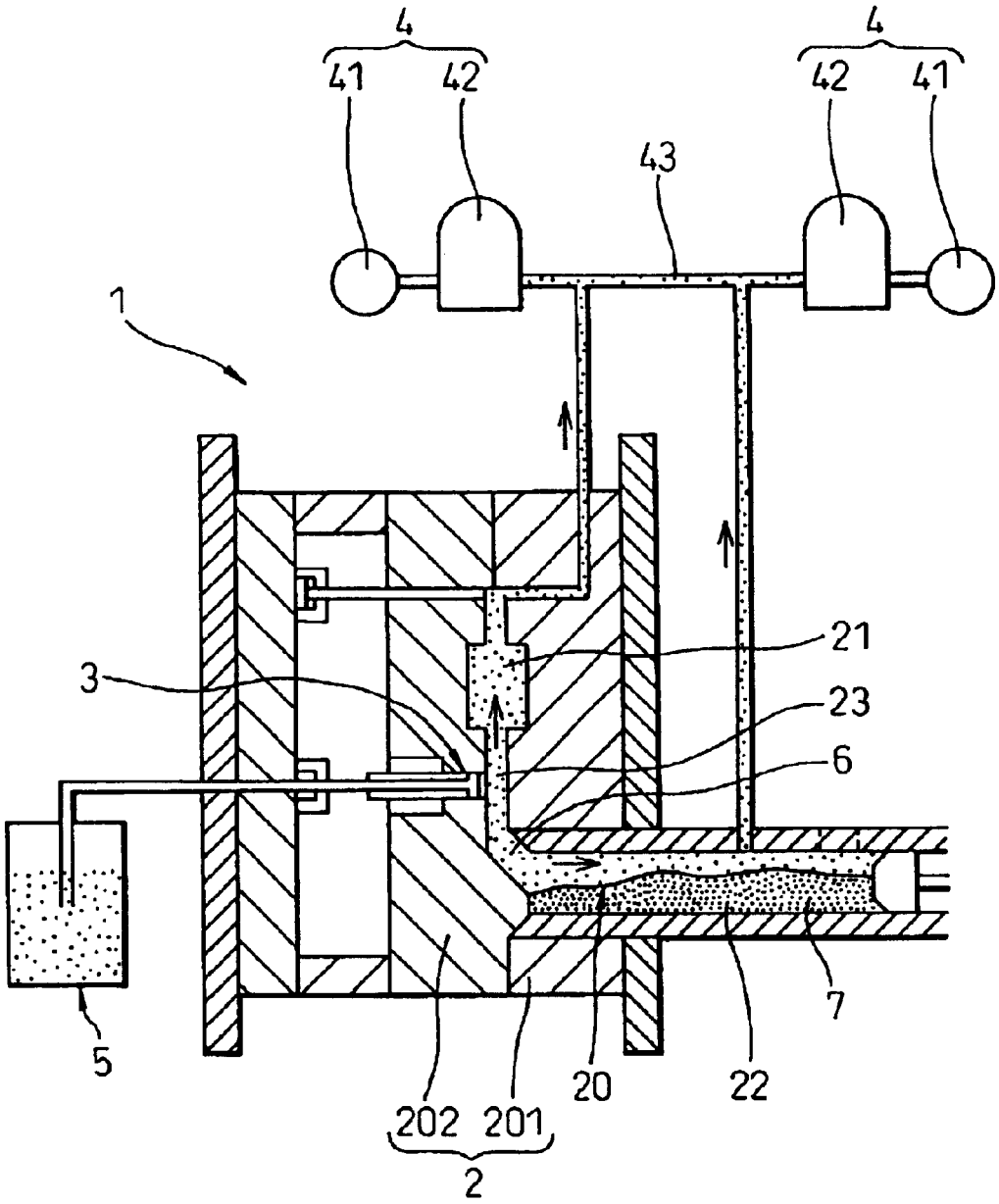

Therefore, as shown in FIG. 8, after the molten metal has been poured, the molten metal pouring port 221 is closed, and pressure of gas in the metallic mold forming section 20 is reduced by the decompressing device 4 to a predetermined degree of vacuum.

Figure 9:
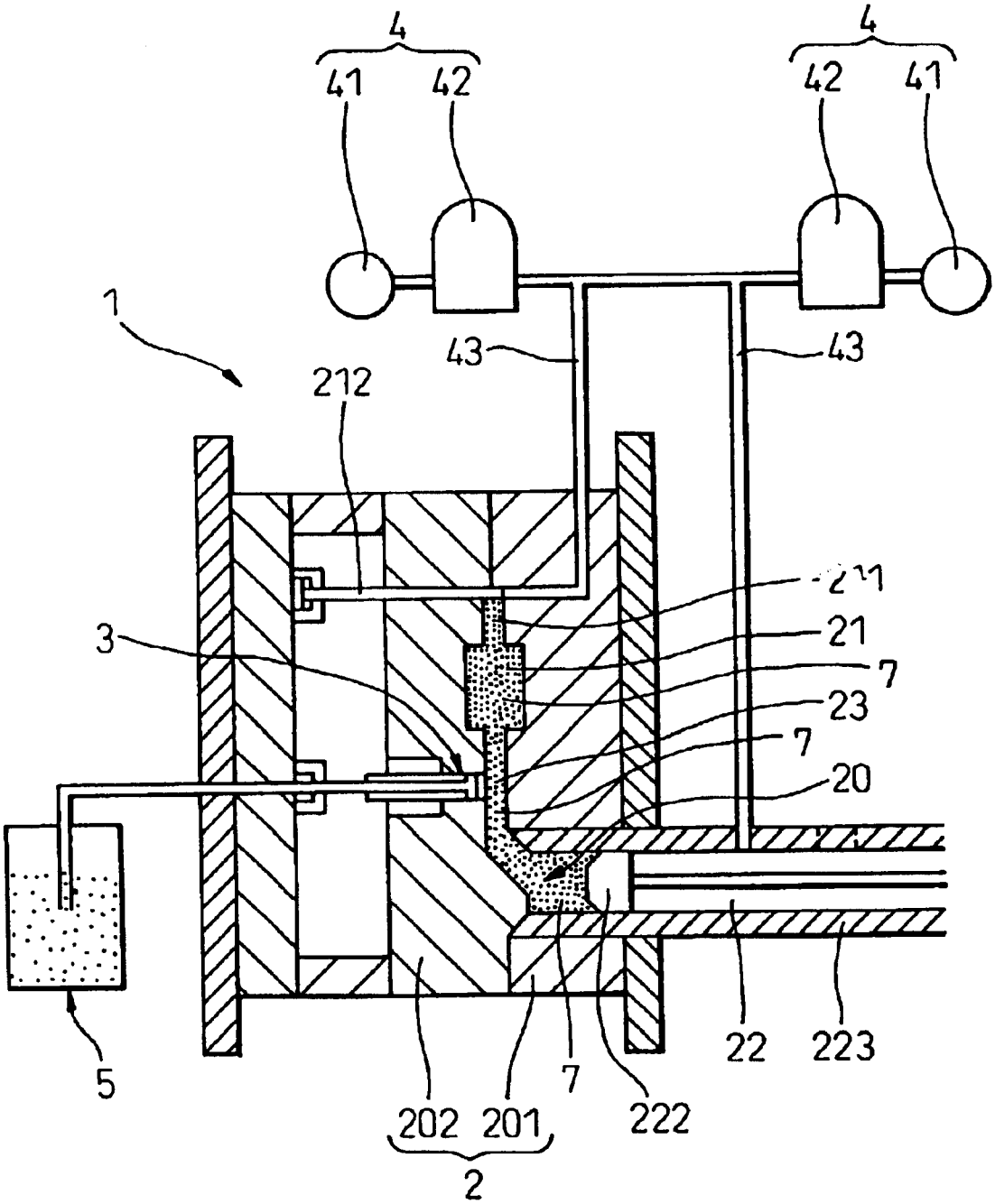

Then, as shown in FIG. 9, after the pressure in the metallic mold forming section 20 has become a predetermined degree of vacuum, the plunger chip 222 of the plunger sleeve section 22 is moved in the sleeve 23, so that the molten metal 7 is pressurized toward the runner 23 and the product cavity section 21. At this time, as the powder discharging pin 3, which is arranged so that it can be advanced into and retracted from the runner 23, is retracted, the molten metal 7 can smoothly flow toward the product cavity section 21.

Two die casting products 8 are simultaneously formed in the two product cavity sections 21. At this time, the molding 81 is formed in the plunger sleeve section 22 and runner 23.

After that, the first metallic mold section 201 and the second metallic mold section 202 are relatively moved and separated from each other. Then, the die casting product 8 connected with the molding 81 is picked up from the metallic mold forming section 20 which includes the product cavity section 21, the plunger sleeve section 22 and the runner 23.

In this connection, the powder mold releasing agent 6 can be supplied by the following force feed system.

The powder supply source 5 holds the powder mold releasing agent 6 in it at a predetermined pressure. When the powder discharging pin 3 is retracted, the first opening section 311 and the second opening section 312 are closed by the inner face of the hole 25 formed in the metallic mold 2 in which the powder discharging pin 3 is arranged. Then, when the powder discharging pin 3 is advanced so that the first opening section 311 and the second opening section 312 are opened, the powder mold releasing agent 6 can be discharged toward the product cavity section 21 and the plunger sleeve section 22 by pressure of the powder supply source 5.

The die casting machine 1 of this embodiment includes a powder discharging pin 3 having a powder introducing passage 31 connected with a powder supply source 5 for supplying a powder mold releasing agent 6. In order to supply a sufficiently large quantity of powder mold releasing agent 6 to the product cavity section 21, this powder discharging pin 3 is arranged so that it can protrude into a runner 23 located between the product cavity section 21 and the plunger sleeve section 22. The powder discharging pin 3 includes: a first opening section 311 which can open the powder introducing passage 31 toward the product cavity section 21 and a second opening section 312 which can open the powder introducing passage 31 toward the plunger sleeve section 22, when the powder discharging pin 3 proceeds into the runner 23.

In the powder discharging pin 3, by the first 311 and the second opening section 312, a plurality of discharging ports to the product cavity section 21 and the plunger sleeve section 22 are formed from one introducing passage of the powder mold releasing agent 6 connected with the powder supply source 5. It is possible to directly supply the powder mold releasing agent 6 toward the product cavity section 21 and the plunger sleeve section 22 from the plurality of discharging ports, that is, from the first opening section 311 and the second opening section 312.

Therefore, it is possible to uniformly spread the powder mold releasing agent 6 to each portion including the product cavity section 21, the plunger sleeve section 22 and the runner 23. Due to the foregoing, the powder mold releasing agent 6 can be supplied in a well balanced state to the product cavity section 21, the plunger sleeve section 22 and the runner 23 in the metallic mold.

Due to the foregoing, for example, even in the case of a large die casting molding, the profile of which is complicated, or even in the case of a complicated die casting molding, in which a plurality of products are molded at one die casting operation, the above powder discharging pin 3 can exhibit an excellent performance, and operation can be flexibly conducted.

When the plunger sleeve section 22 and the product cavity section 21 are decompressed by the decompressing device 4, the powder mold releasing agent 6 can be more effectively supplied to the plunger sleeve section 22 and the product cavity section 21.

The powder discharging pin 3 is arranged in a retractable state with respect to the runner 23. Therefore, after the powder mold releasing agent 6 has been supplied from the powder discharging pin 3, it is possible to retract this powder discharging pin 3. Therefore, when molten metal 7 is charged into the product cavity section 21 via the runner 23, it is possible to prevent the powder discharging pin 3 from blocking the charge of molten metal 7.

Therefore, according to the die casting machine 1 of the embodiment, the powder mold releasing agent 6 can be supplied in a well balanced condition to the product cavity section 21, the plunger sleeve section 22 and the runner 23, and a die casting product 8 of high quality can be produced.

Embodiment 2

Figure 11:
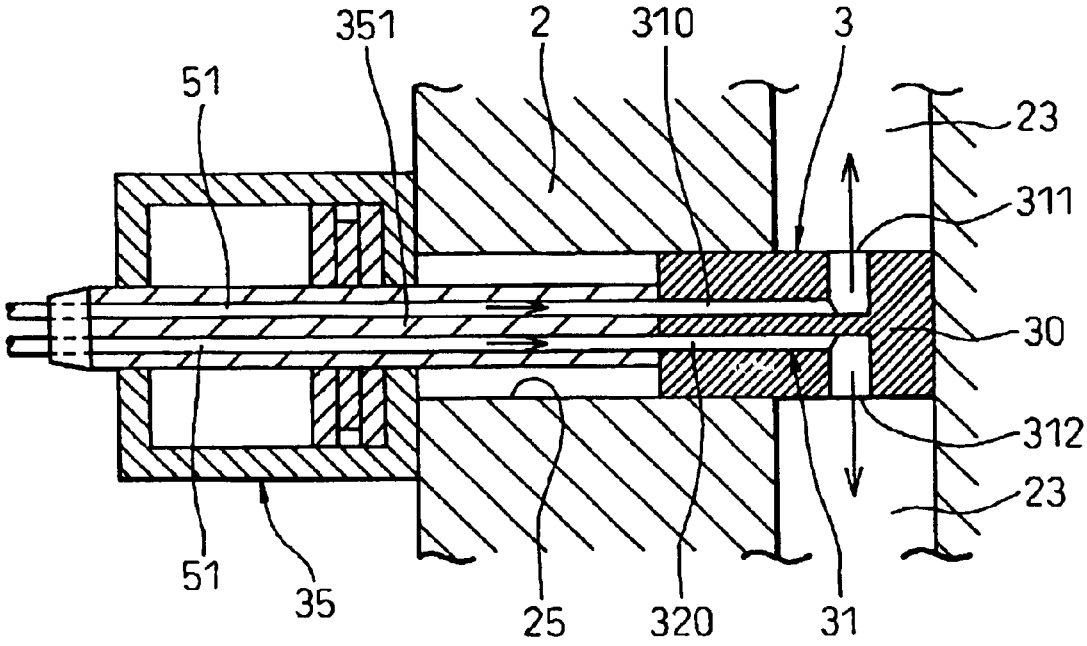
FIG. 11 is a sectional schematic illustration showing a powder discharging pin in Embodiment 2 of the present invention.
Figure 12:
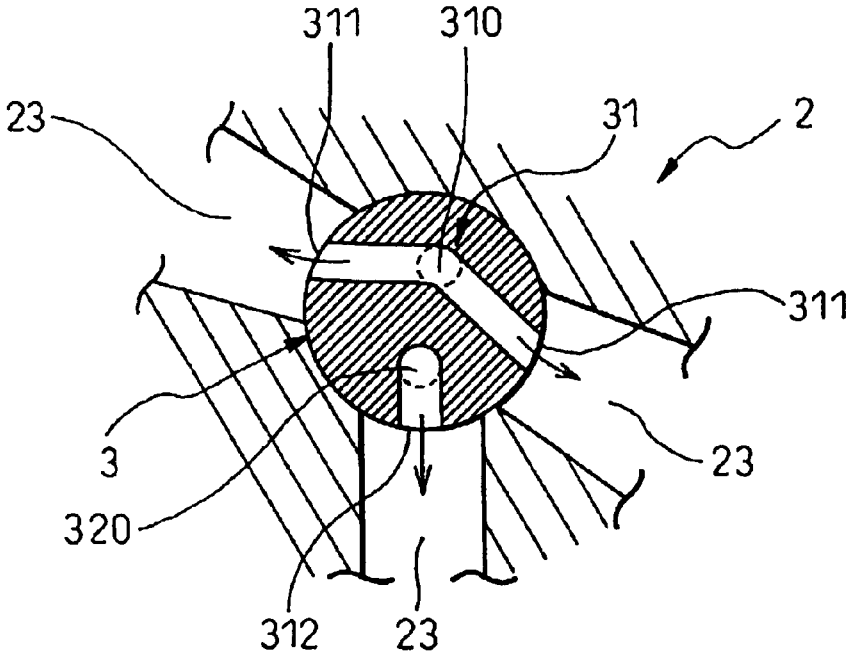
FIG. 12 is a schematic illustration showing an inner structure of the powder discharging pin in Embodiment 2.

As shown in FIGS. 11 and 12, in this embodiment, the powder discharging pin 3 has a plurality of powder introducing passages 31. The powder mold releasing agents 6 of different types are respectively supplied from the powder supply source 5 to the plurality of powder introducing passages 31.

The plurality of powder introducing passages 31 includes: a first powder introducing passage 310 communicated with the first opening section 311; and a second powder introducing passage 320 communicated with the second opening section 312. The powder discharging pin 3 supplies the powder mold releasing agents 6 of different types respectively to the product cavity section 21 and the plunger sleeve section 22. Other points of the structure are the same as those of Embodiment 1 described above.

According to this embodiment, a plurality of powder mold releasing agents 6 having different mold releasing properties, lubricating properties and heat reserving properties can be supplied into between the product cavity section 21 and the plunger sleeve section 22 and also between a plurality of product cavity sections 21 in order to meet to a demand.

That is, in the case where the performance of the powder mold releasing agent 6 required for the product cavity section 21 is different from the performance of the powder mold releasing agent 6 required for the plunger sleeve section 22, it is possible to supply the powder mold releasing agents 6 of different types from the powder supply source 5 into the first powder introducing passage 310 and the second powder introducing passage 320.

Therefore, for example, even when a mold releasing property of the die casting product 8 is required of the product cavity section 21 and even when a lubricating property of the plunger chip 222 and a heat reserving property of the molten metal 7 are required of the plunger sleeve section 22, it is possible to supply powder mold releasing agents 6 having different performances respectively to the first powder introducing passage 31 and the second powder introducing passage 31 according to a demand. Therefore, even in the case of the above complicated requirements, it is possible to flexibly cope with the circumstances.

Other than that, the same effect as that of the Embodiment 1 can be provided.

In this connection, the mold releasing property is defined as the ease of picking up the die casting product 8, which has been formed in the product cavity section 21, from the metallic mold 2 or the ease of picking up the molding 81, which has been formed in the plunger sleeve section 22 and the runner 23, from the metallic mold 2.

The lubricating property is defined as the ease of sliding of the plunger chip 222 (the sliding property of the plunger chip 222) in the plunger sleeve section 22.

The heat reserving property is defined as the ease of holding the temperature of molten metal in the case where the molten metal flows into the metallic mold 2.

Embodiment 3

Figure 14:
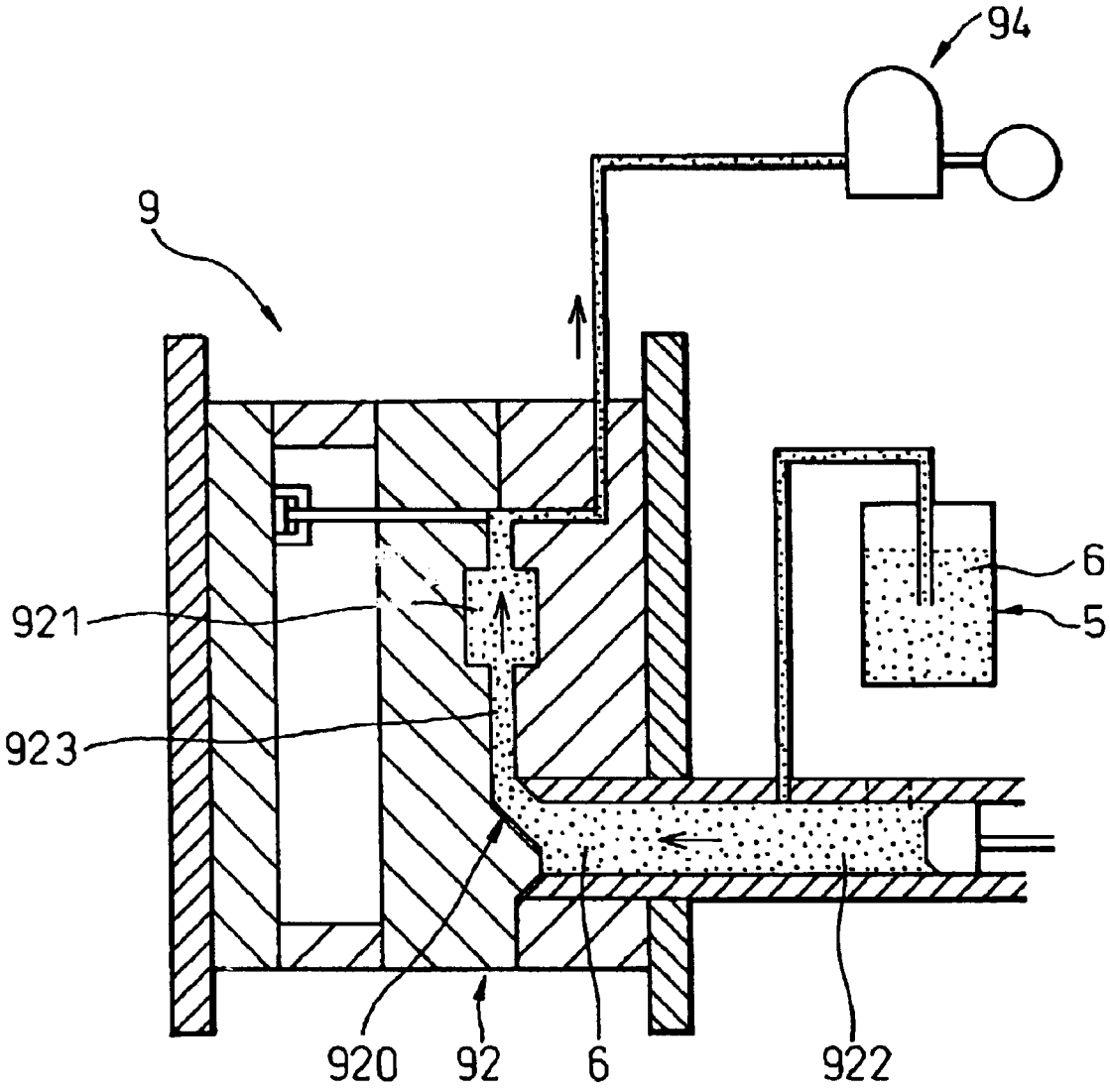
Fig.14 PRIOR ART
FIG. 14 is a sectional schematic illustration showing a die casting machine of a conventional example.

In this embodiment, in order to confirm an excellent operation and effect of the die casting machine 1 described in Embodiment 1, a mold releasing property confirmation test was made with respect to the die casting machine 1 (the die casting machine of the present invention) of Embodiment 1 and the conventional die casting machine (the die casting machine of the comparative example shown in FIG. 14).

In this mold releasing property confirmation test, the die casting product 8 was formed after the powder mold releasing agent 6 was supplied into the metallic mold 2, and then an intensity of the force (mold releasing force) required for picking up the die casting product 8 from the metallic mold was measured.

Figure 13:
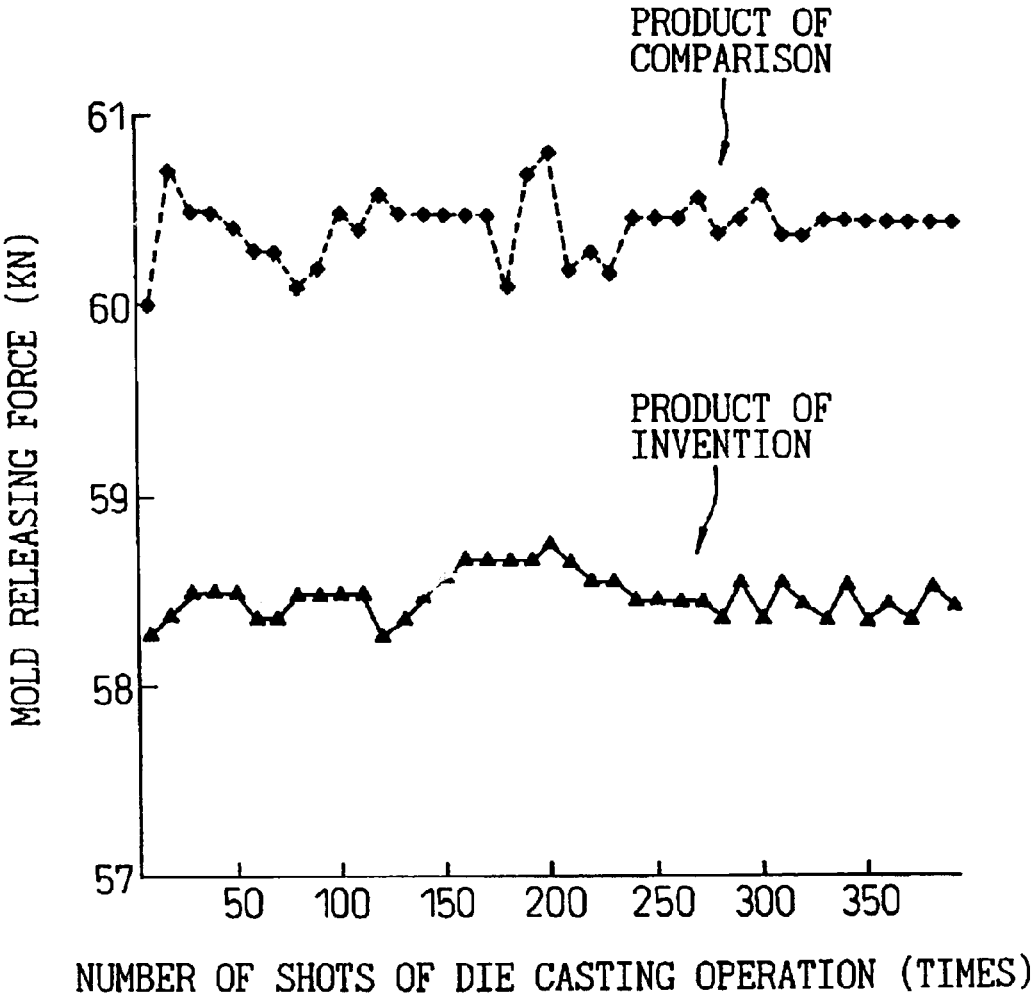
FIG. 13 is a graph showing a relation between the number of shots of a die casting operation and the mold releasing force in Embodiment 3 of the present invention.

The result of measurement is shown in FIG. 13.

On the graph shown in FIG. 13, the axis of the abscissa represents the number of shots of die casting (forming), and the axis of the ordinate represents an intensity of the mold releasing force. The results of measurement are plotted on the graph with respect to the die casting machine of the present invention and the die casting machine of the conventional example.

In this connection, when the die casting product 8 is picked up from the product cavity section 21, the die casting product 8 is connected with the molding 81 which was formed in the plunger sleeve section 22 and the runner 23. Therefore, a value of the intensity of the mold releasing force is obtained when an intensity of the force necessary for picking up the die casting product 8 and an intensity of the force necessary to picking up the molding 81 are added to each other.

From the result of the above measurement, it can be found that even when die casting operation was repeatedly conducted by the number of shots of about 400, the intensity of the mold releasing force of the die casting machine of the present invention is lower than that of the mold releasing force of the die casting machine of the comparative example. The reason is considered as follows. In the case of the die casting machine of the present invention, as the powder mold releasing agent 6 was directly supplied to the product cavity section 21 and the plunger sleeve section 22 by the powder discharging pin 3, the intensity of the mold releasing force could be reduced.

As explained above, the die casting machine and die casting method of the present invention can be applied to production of producing a large die casting product or a die casting product, the profile of which is complicated.

The above die casting machine and the die casting method can be applied to various die casting products used for the production of automobiles.

In the present invention, the powder discharging pin can be arranged at the rod section of the cylinder. When this cylinder is operated between the advancing position and the retracting position, the powder discharging pin can be advanced to and retracted from the runner.

The powder introducing passage formed in the powder discharging pin can branch into a plurality of passages in this powder discharging pin, and the first and the second opening section can be respectively formed at a forward end portion of each branching section.

In the present invention, it is preferable that the decompressing device is directly connected with the product cavity section and the plunger sleeve section.

In the case where the powder mold releasing agent is supplied from the powder discharging pin to each of the product cavity section, the plunger sleeve section and the runner of the metallic mold, the product cavity section and the plunger sleeve section can be directly decompressed. Therefore, the powder mold releasing agent can be supplied to each section of the metallic mold in a well balanced condition.

It is preferable that a plurality of product cavity sections are arranged and a plurality of the first opening sections are arranged being open toward the product cavity sections.

In the aforementioned case, the die casting machine simultaneously produces a plurality of die casting products by one die casting operation. In this case, when each first opening section opens toward each product cavity section, the powder mold releasing agent can be supplied to each product cavity section in a well balanced condition. Therefore, it is possible to simultaneously produce a plurality of die casting products of high quality by one die casting operation.

It is preferable that the powder discharging pin has a plurality of powder introducing passages and that the powder mold releasing agents of different types are respectively supplied from the powder supply source into the plurality of powder introducing passages.

Even in the case where the required performance of the powder mold releasing agent such as a mold releasing property, lubricating property and heat reserving property is different, according to the different performance of the powder mold releasing agent, the powder mold releasing agent having the different performance can be supplied into between the product cavity section and the plunger sleeve section or between the plurality of product cavity sections. Therefore, even in the case where the above complicated requirement is made, the die casting machine can flexibly cope with the circumstances.

The above plurality of powder introducing passages includes the first powder introducing passage communicated with the first opening section and the second powder introducing passage communicated with the second opening section, and the powder mold releasing agents of different types can be respectively supplied to the product cavity section and the plunger sleeve section.

In this case, the powder introducing passage is divided into the first powder introducing passage, which is directed toward the product cavity section, and the second powder introducing passage which is directed toward the plunger sleeve section, and the powder mold releasing agents of different types are supplied from the powder supply source.

Due to the foregoing, the following advantages can be provided. For example, in the case where the mold releasing property of the die casting product is demanded of the product cavity section, and further in the case where the lubricating property of the plunger chip and the heat reserving property of molten metal are demanded of the plunger sleeve section, the powder mold releasing agents, the performance of which is different from each other, can be respectively supplied to the first powder introducing passage and the second powder introducing passage according to the demand. Therefore, even in the case where the above complicated requirement is made, the die casting machine can flexibly cope with the circumstances.

It is preferable that the powder discharging pin is composed in such a manner that the forward end portion of the powder discharging pin intercepts a communicating state between the product cavity section and the plunger sleeve section in the runner in the case of advancing and that the forward end portion of the powder discharging pin restores a communicating state between the product cavity section and the plunger sleeve section in the runner in the case of retracting.

In this case, the state of communication between the product cavity section and the plunger sleeve section is defined as a state in which a sectional area of the passage in the runner is not extremely changed so that a flow of the molten metal is not affected. The state of interception between the product cavity section and the plunger sleeve section is defined as a state in which the sectional area of the passage is extremely reduced when the powder discharging pin is located in the runner.

When the powder mold releasing agent is discharged from the powder discharging pin into the runner of the metallic mold, the powder discharging pin is advanced, so that a communicating state between the product cavity section and the plunger sleeve section is intercepted. Simultaneously with the interception of the communicating state, the first and the second opening section of the powder introducing passage are respectively opened toward the product cavity section and the plunger sleeve section.

Therefore, it is possible to prevent the powder mold releasing agent, which has been discharged from the first opening section, and the powder mold releasing agent, which has been discharged from the second opening section, from mixing with each other in the runner.

When molten metal is charged into the product cavity section via the runner of the metallic mold, the powder discharging pin is retracted so that the communicating state is restored. Therefore, it is possible to prevent the powder discharging pin from blocking the charge of molten metal into the product cavity section.

It is preferable that the powder discharging pin is composed in such a manner that a ratio of a quantity of the powder mold releasing agent supplied to the product cavity section to a quantity of the powder mold releasing agent supplied to the plunger sleeve section can be adjusted by changing a ratio of the opening area of the first opening section to the opening area of the second opening section.

Due to the foregoing, when a volume of the product cavity section and a volume of the plunger sleeve section are different from each other in the metallic die or when a quantity of powder mold releasing agent supplied to the product cavity section and a quantity of powder mold releasing agent supplied to the plunger sleeve section must be different from each other, the die casting machine of the embodiment can flexibly cope with the circumstances.

In the present invention, the decompressing device is directly connected with the product cavity section and the plunger sleeve section. It is preferable that the product cavity section and the plunger sleeve section are directly decompressed.

In this case, the product cavity section and the plunger sleeve section can be respectively directly decompressed, so that the powder mold releasing agent can be supplied to each portion of the metallic mold in a well balanced condition.

It is preferable that a plurality of the product cavity sections are provided and, further, that a plurality of the first opening sections are provided being open toward the product cavity sections so that the powder mold releasing agent is supplied from the first opening sections to the product cavity sections.

In the aforementioned case, the die casting machine simultaneously produces a plurality of die casting products by one die casting operation. In this case, when each first opening section opens toward each product cavity section, the powder mold releasing agent can be supplied to each product cavity section in a well balanced condition. Therefore, it is possible to simultaneously produce a plurality of die casting products of high quality by one die casting operation.

While the invention has been described by reference to specific embodiments chosen for purposes of illustration, it should be apparent that numerous modification could be made thereto by those skilled in the art without departing from the basic concept and scope of the invention.

What is claimed is:

1. A die casting machine comprising:

a metallic mold including a plunger sleeve section for injecting molten metal, a product cavity section for molding a die casting product when molten metal is charged into it and a runner for connecting the plunger sleeve section with the product cavity section;

a decompressing device for decompressing the plunger sleeve section and the product cavity section;

a powder supply source for supplying a powder mold releasing agent to the plunger sleeve section and the product cavity section; and a powder discharging pin arranged in the runner in a retractable state, having a powder introducing passage connected with the powder supply source, wherein the powder discharging pin includes a first opening section to open the powder introducing passage toward the product cavity section and a second opening section to open the powder introducing passage toward the plunger sleeve section.

2. A die casting machine according to claim 1, wherein the decompressing device is directly connected with the product cavity section and the plunger sleeve section.

3. A die casting machine according to claim 1, wherein a plurality of product cavity sections are provided and the first opening section is open toward each product cavity section.

4. A die casting machine according to claim 1, wherein the powder discharging pin includes a plurality of powder introducing passages, and powder mold releasing agents of different types are respectively supplied from the powder supply source into the plurality of powder introducing passages.

5. A die casting machine according to claim 4, wherein the plurality of powder introducing passages include a first powder introducing passage communicated with the first opening section and a second powder introducing passage communicated with the second opening section, and the powder mold releasing agents of different types are respectively supplied to the product cavity section and the plunger sleeve section.

6. A die casting machine according to claim 1, wherein the powder discharging pin is composed in such a manner that the forward end portion of the powder discharging pin intercepts a communicating state between the product cavity section and the plunger sleeve section in the runner in the case of advancing and that the forward end portion of the powder discharging pin does not intercept the communicating state between the product cavity section and the plunger sleeve section in the runner in the case of retracting.

7. A die casting machine according to claim 1, wherein a ratio of an opening area of the first opening section to an opening area of the second opening section is set up in such a manner that a ratio of a quantity of the powder mold releasing agent supplied to the product cavity section to a quantity of the powder mold releasing agent supplied to the plunger sleeve section becomes a predetermined ratio.

8. A die casting method in which molten metal is injected from a plunger sleeve section provided in a metallic mold and the injected molten metal is filled in a cavity product section via a runner so as to produce a die casting product, comprising the steps of:

decompressing the product cavity section and the plunger sleeve section before molten metal is injected from the plunger sleeve section when a powder mold releasing agent is supplied to the product cavity section and the plunger sleeve section;

advancing a powder discharging pin, which is arranged in the runner in a retractable state and has a powder introducing passage connected with a powder supply source, into the runner;

opening a first opening section provided in the powder introducing passage of the powder discharging pin toward the product cavity section and also opening a second opening section provided in the powder introducing passage toward the plunger sleeve section; and discharging the powder mold releasing agent from the first and the second opening section.

9. A die casting method according to claim 8, wherein the decompressing device is directly connected with the product cavity section and the plunger sleeve section, and the product cavity section and the plunger sleeve section are respectively directly decompressed.

10. A die casting method according to claim 8, wherein a plurality of the product cavity sections are arranged, a plurality of the first opening sections are open toward the product cavity sections, and the powder mold releasing agent is supplied from each first opening section to each product cavity section.

11. A die casting method according to claim 8, wherein the powder discharging pin includes a plurality of powder introducing passages, and powder mold releasing agents of different types are supplied from the powder supply source into the plurality of powder introducing passages.

12. A die casting method according to claim 11, wherein the plurality of powder introducing passages includes a first powder introducing passage communicated with the first opening section and a second powder introducing passage communicated with the second opening section, and the powder mold releasing agents of different types are respectively supplied to the product cavity section and the plunger sleeve section.

13. A die casting method according to claim 8, wherein the powder discharging pin is composed in such a manner that the forward end portion of the powder discharging pin intercepts a communicating state between the product cavity section and the plunger sleeve section in the runner in the case of advancing and that the forward end portion of the powder discharging pin does not intercept the communicating state between the product cavity section and the plunger sleeve section in the runner in the case of retracting.

14. A die casting method according to claim 8, wherein a ratio of an opening area of the first opening section to an opening area of the second opening section is set up in such a manner that a ratio of a quantity of the powder mold releasing agent supplied to the product cavity section to a quantity of the powder mold releasing agent supplied to the plunger sleeve section becomes a predetermined ratio.

* * * * *